United States Patent [19]

Martel et al.

[11] Patent Number: 4,772,027

[45] Date of Patent: Sep. 20, 1988

[54] BOARD GAME INCORPORATING ELECTRONIC LOGIC DEVICE

[76] Inventors: Robert J. Martel, 1 Elouera Rd., Avalon, N.S.W. 2107; Thomas G. Bishop, 47 Dunella Avenue, Sherwood, Queensland, both of Australia

[21] Appl. No.: 898,240

[22] Filed: Aug. 20, 1986

[30] Foreign Application Priority Data

Aug. 23, 1985 [AU] Australia ..... PH2110

[51] Int. Cl.[4] ..... A63F 3/00

[52] U.S. Cl. ..... 273/237; 273/287; 434/352

[58] Field of Search ..... 273/1 E, 1 GC, 85 G, 273/1 GE, 237, 238, 284, 287, 285; 434/336, 350–352, 364

[56] References Cited

U.S. PATENT DOCUMENTS

| | | | |
|---|---|---|---|
| 3,113,778 | 12/1963 | Silverman | 273/284 |
| 3,763,577 | 10/1973 | Goodson | 434/352 |
| 3,825,266 | 7/1974 | Bissell | 273/237 |
| 4,036,500 | 7/1977 | Kierman | 273/1 E |
| 4,207,087 | 6/1980 | Morrison et al. | 273/1 E |
| 4,339,135 | 7/1982 | Breslow et al. | 273/237 |
| 4,444,391 | 4/1984 | Kaga et al. | 434/352 |

*Primary Examiner*—Maryann Lastova

*Attorney, Agent, or Firm*—Ostrolenk, Faber, Gerb & Soffen

[57] ABSTRACT

A board game which comprises a board on which objects can be placed by participating players. An electrically powered sensor/indicator device is mounted to the board, the device incorporating electronic logic circuitry and indicator elements connected to the logic circuitry. A plurality of triggering devices are electrically connected to the logic circuitry. The triggering devices are operable by players of the game and the logic circuitry is actuatable by the triggering devices to electrically operate the indicator elements to signify a player who has first operated one of the triggering devices.

11 Claims, 2 Drawing Sheets

BOARD GAME INCORPORATING ELECTRONIC LOGIC DEVICE

BACKGROUND OF THE INVENTION

This invention relates to a board game which is intended to be played by at least two persons. The game per se is variable, in the sense that the board may be printed with patterns or indicia applicable to any one of a number of different games, or the board may be arranged to carry overlays which are printed with material applicable to different types of games. However, a constant feature of the invention is that the board is arranged to carry or to be mounted to a sensor/indicator device which is electrically connected to associated switches. The switches are activated by persons who participate in the game.

Most board games are played by persons who take turns in participating in the game and play progresses around the board. Movement or placement of objects on the board might be determined by the throw of dice, as in the case of such games as backgammon or Trivial Pursuit (trademark). In other games, such as chess or Scrabble (trademark), play simple moves from one player to the other as successive moves are made by the players.

In contrast with the present invention, as hereinafter defined, no prior art board games are known to involve the use of devices which are operated by players and which, depending upon which of the players is first to trigger the device, creates an entitlement for the player to make a move or otherwise engage in play. There are quiz games which are played by a panel of persons and in which participating players signify their desire to answer a question by triggering an indicator device. However, such quiz games do not involve the use of a board on which objects are placed or moved as an integral part of the game.

BRIEF SUMMARY OF THE INVENTION

The present invention distinguishes over prior art arrangements in that it is directed to a board game which comprises a board on which objects can be placed by participating players. An electrically powered sensor/indicator device is mounted or is arranged to be mounted to the board, the device incorporating electronic logic circuitry and indicator elements connected to the logic circuitry. A plurality of triggering devices are electrically connected to the logic circuitry. The triggering devices are operable by players of the game and the logic circuitry is actuatable by the triggering devices to electrically operate the indicator elements to signify a player who has first operated one of the triggering devices.

The sensor/indicator device may be permanently mounted to the board but preferably it is removably mounted, so that the board may be folded and stowed in a container. Most preferably, the board incorporates a cut-out which is shaped to fit around the sensor/indicator device and the board is mounted to the device in close fitting engagement.

The sensor/indicating device preferably comprises a housing which is moulded from a plastics material, which is fitted with exposed indicator lamps or light emitting diodes and which contains electrical circuitry which is arranged to cause energisation of a selected one or more of the lamps or light emitting diodes. The housing may be fitted with a photovoltaic cell for powering the electrical circuitry but, preferably, batteries are employed for this purpose and contained within the housing.

The triggering devices may comprise switches which are permanently mounted to the board or they may be formed as metal strips, which provide for capacitive or inductive switching, which are located within the thickness of the board. However, as in the case of the sensor/indicator device, the triggering devices preferably are removably mounted to the board and, most preferably, are located within cut-outs in the board.

In a particularly preferred form of the invention, each triggering device comprises a push-button switch which is located within a plastics material casing. The switches are connected by wires to the sensor/indicator device, and the sensor/indicator device is centrally located with respect to the triggering devices.

The board game may be adapted for playing different types of games, by incorporating overlay sheets fitting over the board itself. Each overlay sheet would be printed with material appropriate to a particular game. The overlay sheets normally would be provided with cut-outs in the same manner as the board, to accommodate the sensor/indicator device and the triggering devices. Thus, when the various components of the game are interfitted, the sensor/indicating device and triggering devices protrude through and hold the overlay sheets in position on the board.

BRIEF DESCRIPTION OF THE DRAWINGS

The invention will be more fully understood from the following description of a preferred embodiment of a board game which is illustrated in the accompanying drawings. In the drawings.

DETAILED DESCRIPTION OF THE DRAWINGS

Figure 1:
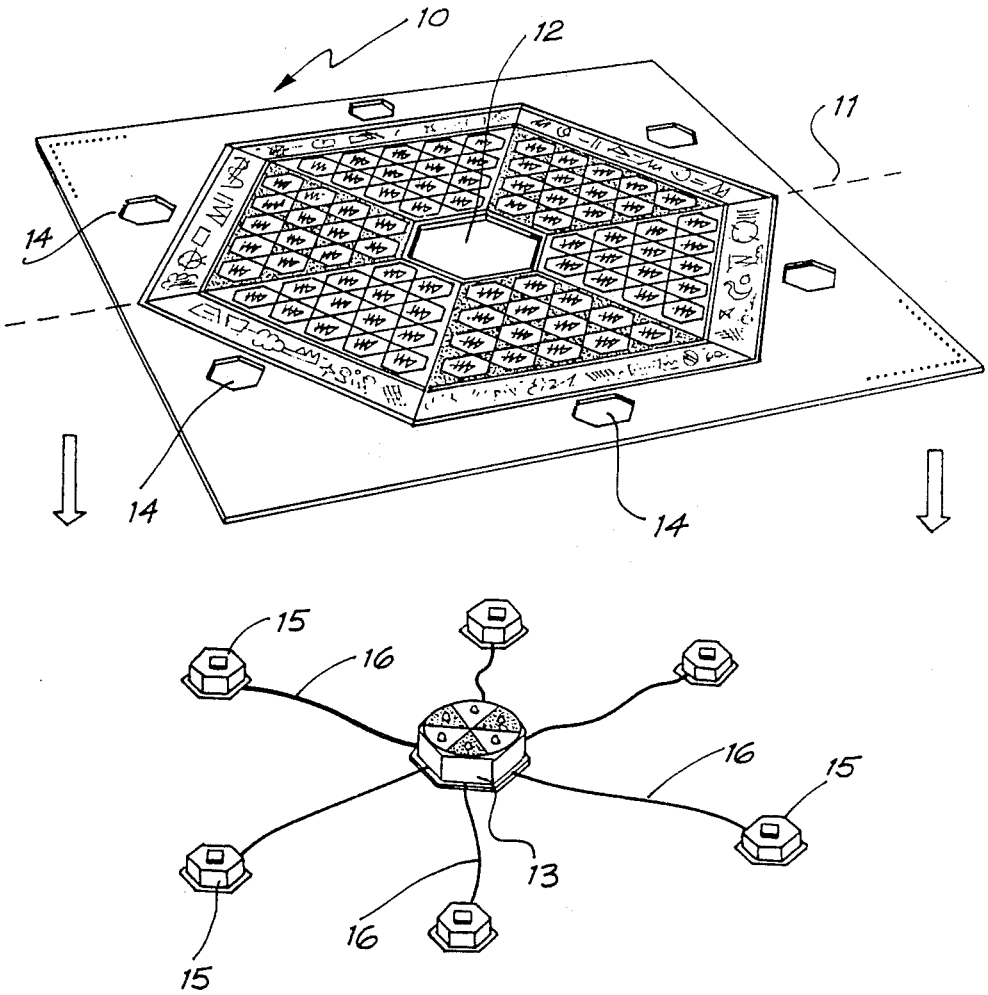
FIG. 1 shows an exploded perspective view of the complete board game.

As illustrated in the drawings, the game comprises a board 10 which is printed on its upper surface with material appropriate to a particular game. The board is creased so that it may be folded about the chain-dotted line 11, so that it may be stowed conveniently.

Although not shown in the drawings, loose sheets may be provided for overlaying the board 10. Each sheet will have dimensions and cut-outs in it to match those of the board, and the various sheets may be printed with different material, so that the respective sheets may be used in the playing of different games.

Figure 2:
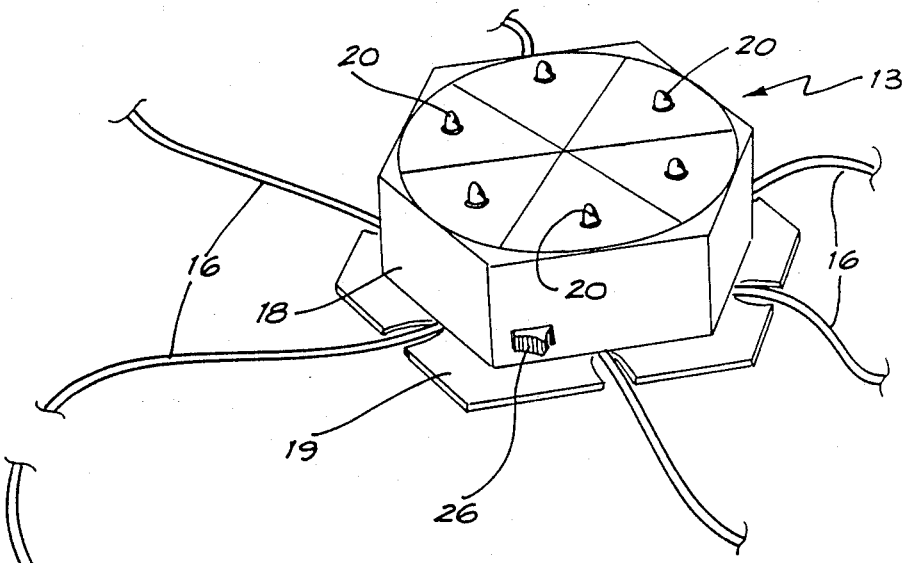
FIG. 2 shows a perspective view of a sensor/indicator device and one triggering device removed from the board of FIG. 1.

The board 10 is formed with a central cut-out 12 which is dimensioned to fit neatly around a sensor/indicator device 13 which is shown in FIGS. 1 and 2. Additionally, the board 10 is formed with six equispaced (smaller) cut-outs 14 which are positioned and dimensioned to fit neatly about six switch devices 15.

The cut-outs 12 and 14 are hexagonal, as are the bodies of the sensor/indicator device 13 and the switch devices 15. The switch devices 15 are connected to the sensor/indicator device 13 by radially extending wires 16.

As shown in FIG. 2, the sensor/indicator device 13 comprises a plastics material housing 18 which has a generally hexagonal form. A lower flange 19 extends around the housing 18 and, when the board 10 is fitted to the sensor/indicator device 13, the inner margin of the board which surrounds the cut-out 12 sits on the flange 19.

An access hatch (not shown) is located at the underside of the housing 18, and logic circuitry and a power supply in the form of a number of batteries are located within the housing 18. Six light emitting diodes (LED's) 20 are connected to the logic circuitry and project through the upper surface of the housing 18.

Each of the triggering devices or switches 15 comprises a push button switch 21 within a housing 22. The housing is moulded in a hexagonal shape and it has a lower flange 23 which locates below the cut-out 14 in the board 10 when the board is fitted to the switches 15. Each housing is a different colour to distinguish between the individual switches. The colours choosen in this instance are red, blue, brown, green, yellow and purple.

Figure 3:
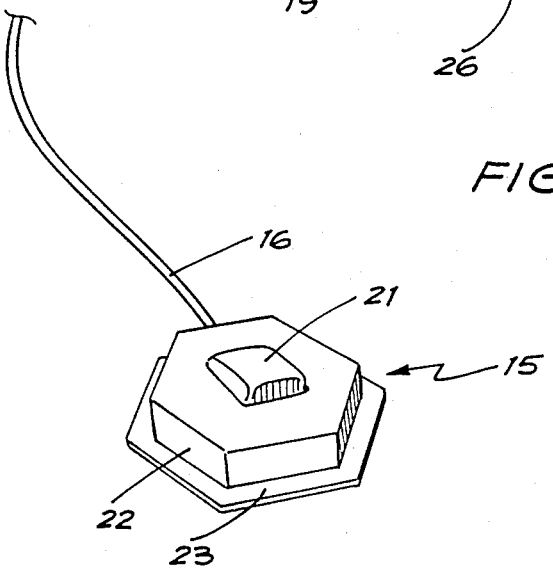
FIG. 3 shows a schematic representation of electrical circuitry associated with the board game.
Figure 3:
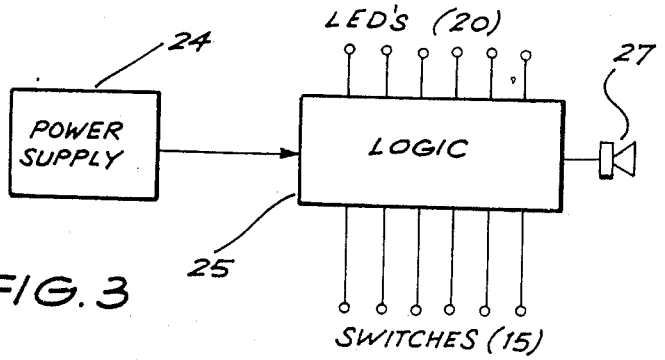

FIG. 3 shows a schematic representation of the electrical circuit and it can be seen to comprise a power supply 24 which includes the batteries to which reference has previously been made. The power supply is connected to a logic circuit 25 by way of a switch 26 which is shown in FIG. 2.

The logic circuit 25 is activated when any one of the switches 15 is operated. However, the function that the logic circuit provides may be varied. The various functions are controlled by a customised i.c. chip forming part of the logic circuit. In this embodiment, the logic circuit may operate in one of three different modes, the modes being selectable during the switching on procedure. To select the first mode (umpire mode) the switch 26 is simply turned on. To select the second mode (dice mode) switch 26 is turned on while holding down a particular one of the tiggering devices, say the red switch. The third mode (timer mode) is selected by turning on switch 26 when holding down a different particular one of the triggering devices, say the blue switch. This procedure may be extended to cover additional modes of operation not described.

In the umpire mode, the logic circuit 25 is activated when any one of the switches 15 is operated. The logic circuit senses which switch was the first to be operated and initially illuminates all of the LED's 20 either individually or simultaneously. At the same time it initiates an audible output from a miniture loudspeaker 27. Thereafter, the logic circuit 25 causes one LED to remain illuminated for a short period of time to indicate which of the switches 15 was first to be actuated. Until this short period has expired the logic circuit cannot be re-activated.

In the dice mode, the logic circuit 25 is actuated by operating any one of the switches 15. The logic circuit then selects LED's in a random fashion until one LED is selected and held on for a short period. After this short period has expired the LED is turned off and the logic circuit is re-set awaiting the next switch to be operated. The final LED is selected randomly having no apparent relationship with the switch being actuated or the last LED to be illuminated. Each LED is ascribed a value from 1 to 6.

The timer mode actually consists of six different sequences controlled by the individual switches 15. The timer mode counts down a pre-set period. The logic circuit is again activated by operation of one of the switches 15. Which switch is operated will determine which time period is timed out. For example, the following time periods may be used - brown: 75s, blue: 60s, red: 30s, purple: 20s, yellow: 12s and green: 8s. During the timing out period the LED associated with the switch operated will flash to indicate which time period is being timed. During the last moment of the period, say the last five seconds, the LED will flash faster and the loudspeaker will beep to signify the approaching end of the period. At the end of the period, the LED will light up for an extended flash and the loud speaker will give an extended beep of say one to two seconds to indicate the end of the period. At any time during the timing period the sequence may be stopped by operating the same switch that started the timing sequence.

In all modes if any one of the switches 15 is held closed when a sequence finishes, the LED associated with that switch will flash to indicate that the switch is being held in the closed state and the sequence is prevented from being reinitiated.

We claim:

1. A board game comprising:

a board on which objects can be placed by participating players in the game;

an electrically powered sensor/indicator device mounted to the board, the device incorporating programmed electronic logic means for performing a plurality of functions;

indicator means connected to the logic means for providing indications in response to said functions performed by said logic means; and a plurality of triggering means electrically connected to the logic means for selecting and initiating a selected one of said functions to be performed by said logic means;

the plurality of triggering means being mounted to the board for being operable by respective players participating in the game; and the logic means being actuatable by the triggering means and programmed:

(a) to electrically operate one of the indicator means to provide an umpire indication to signify a player who first operates a respective one of the triggering means, and not to signify another player who operates another one of the triggering means during said umpire indication; and (b) to operate a randomly selected one of said indicator devices to provide a dice indication in response to the operation of one of the triggering means.

2. A board game as defined in claim 1, wherein the logic means is programmed to be operated by the triggering means to time out a plurality of predetermined time periods, the particular time period to be timed out being selectable in dependence on which one of the triggering means is operated.

3. A board game as defined in claim 1, wherein the indicator means comprise a plurality of light emitting diodes mounted to and extending from an upper casing portion of the sensor/indicator device.

4. A board game as defined in claim 1, wherein the sensor/indicator device is removably mounted to the board by means of a cut-out in the board, shaped to fit around the sensor/indicator device in a close fitting engagement, the board being supported on a flange extending from a lower casing portion of the sensor/indicator device.

5. A board game as defined in claim 1, wherein the triggering means are switches connected to the sensor-/indicator device by electrical wires.

6. A board game as defined in claim 5, wherein the triggering means are removably mounted to the board by means of cut-outs in the board, shaped to fit around the individual triggering means in a close fitting engagment, the board being supported by a flange extending from a lower casing portion of each triggering means.

7. A board game as defined in claim 1, including an overlay sheet carrying printed material, different from the material printed on the board, the overlay sheet being arranged to fit over the board.

8. A board game as defined in claim 1, in which said electronic logic means comprises ON/OFF means, and a programmed function to be performed by said logic means is selected in response to a operation of the triggering means at the time said ON/OFF means is turned ON.

9. A board game as defined in claim 8, in which said function to be performed is selected by not operating said triggering means at the time said ON/OFF means is turned ON.

10. A board game as defined in claim 8, in which each of said programmed functions is selected by operating a respective one of said triggering means at the time said ON/OFF means is turned ON.

11. A board game as defined in claim 1, in which said dice indication is provided in response to operating any one of said triggering means.

* * * * *